US010391518B2

(12) United States Patent
Kim et al.

(10) Patent No.: US 10,391,518 B2
(45) Date of Patent: Aug. 27, 2019

(54) METHOD FOR MANUFACTURING TRANSPARENT PATTERN PRINT STEEL PLATE

(71) Applicant: POSCO, Pohang-si, Gyeongsangbuk-do (KR)

(72) Inventors: Jin-Tae Kim, Gwangyang-si (KR); Jong-Sang Kim, Gwangyang-si (KR); Bong-Woo Ha, Gwangyang-si (KR); Yang-Ho Choi, Gwangyang-si (KR); Jung-Hwan Lee, Gwangyang-si (KR); Ha-Na Choi, Gwangyang-si (KR); Jong-Kook Kim, Gwangyang-si (KR)

(73) Assignee: POSCO, Pohang-si, Gyeongsangbuk-Do (KR)

( * ) Notice: Subject to any disclaimer, the term of this patent is extended or adjusted under 35 U.S.C. 154(b) by 165 days.

(21) Appl. No.: 15/539,662

(22) PCT Filed: Aug. 19, 2015

(86) PCT No.: PCT/KR2015/008645
§ 371 (c)(1),
(2) Date: Jun. 23, 2017

(87) PCT Pub. No.: WO2016/104913
PCT Pub. Date: Jun. 30, 2016

(65) Prior Publication Data

US 2017/0354991 A1 Dec. 14, 2017

(30) Foreign Application Priority Data

Dec. 23, 2014 (KR) ..... 10-2014-0187637

(51) Int. Cl.
*B05D 3/06* (2006.01)
*B05D 7/14* (2006.01)
(Continued)

(52) U.S. Cl.
CPC ..... *B05D 3/061* (2013.01); *B05D 3/02* (2013.01); *B05D 3/067* (2013.01); *B05D 3/142* (2013.01);
(Continued)

(58) Field of Classification Search
CPC ..... B05D 3/061; B05D 3/02; B05D 3/067; B05D 3/142; B05D 7/14; B05D 7/53;
(Continued)

(56) References Cited

U.S. PATENT DOCUMENTS 5,718,793 A * 2/1998 Inamoto ..... B41J 2/01 156/235
6,017,661 A * 1/2000 Lindsay ..... B41M 3/14 106/31.01
(Continued)

FOREIGN PATENT DOCUMENTS

EP 3238835 A1 * 11/2017 ..... B05D 7/14
EP 3238835 A4 * 3/2018 ..... B05D 7/14
(Continued)

OTHER PUBLICATIONS

International Search Report and Written Opinion issued in International Patent Application No. PCT/KR2015/008645, dated Oct. 29, 2015; with partial English translation.
(Continued)

*Primary Examiner* — Stephen M Gravini
(74) *Attorney, Agent, or Firm* — Morgan, Lewis & Bockius LLP

(57) ABSTRACT

A method of manufacturing a transparent pattern printed steel plate includes forming a printed paint film layer by jetting transparent ink onto at least one surface of a steel plate, and curing the printed paint film layer with ultraviolet light to form a cured printed paint film layer. Further, a method of manufacturing a transparent pattern printed steel
(Continued)

plate includes preparing a steel plate having a color painted film layer formed on at least one surface thereof, forming a printed paint film layer by jetting transparent ink onto the color painted film layer, and curing the printed paint film layer to form a cured printed paint film layer.

18 Claims, 1 Drawing Sheet

(51) Int. Cl.

| | |
|---|---|
| ***B05D 3/14*** | (2006.01) |
| ***B41M 5/00*** | (2006.01) |
| ***B41M 7/00*** | (2006.01) |
| ***B05D 3/02*** | (2006.01) |
| ***B05D 7/00*** | (2006.01) |

(52) U.S. Cl.
CPC ..... *B05D 7/14* (2013.01); *B41M 5/0058* (2013.01); *B41M 7/0081* (2013.01); *B05D 7/53* (2013.01); *B05D 2202/10* (2013.01); *B41M 5/0047* (2013.01)

(58) Field of Classification Search
CPC ..... B05D 2202/10; B41M 5/0058; B41M 7/0081; B41M 5/0047
USPC ..... 34/275
See application file for complete search history.

(56) References Cited

U.S. PATENT DOCUMENTS

| | | | | |
|---|---|---|---|---|
| 6,561,100 | B1 * | 5/2003 | Buse | B41M 5/508 101/487 |
| 6,780,897 | B1 * | 8/2004 | Blum | B05D 3/0209 522/110 |
| 7,913,382 | B2 * | 3/2011 | Heitzinger | G03F 7/40 29/832 |
| 8,337,007 | B2 * | 12/2012 | Wang | C09D 11/101 347/102 |
| 10,189,281 | B2 * | 1/2019 | Pervan | B41J 11/002 |
| 2001/0038408 | A1 * | 11/2001 | Codos | B41J 2/01 347/102 |
| 2002/0044188 | A1 * | 4/2002 | Codos | B41J 2/01 347/106 |
| 2002/0076505 | A1 * | 6/2002 | Tanimoto | B05D 7/534 427/551 |
| 2003/0207956 | A1 * | 11/2003 | Balch | B05D 3/0209 522/104 |
| 2005/0095364 | A1 * | 5/2005 | Curcic | B05D 1/286 427/372.2 |
| 2006/0035034 | A1 | 2/2006 | Matsumoto et al. | |
| 2010/0007692 | A1 * | 1/2010 | Vanmaele | B41C 1/003 347/21 |
| 2010/0242299 | A1 * | 9/2010 | Siegel | B41F 23/0409 34/275 |
| 2012/0164402 | A1 | 6/2012 | Murakami et al. | |
| 2012/0206534 | A1 | 8/2012 | Fassam et al. | |
| 2014/0178513 | A1 * | 6/2014 | Matthews | B29C 47/54 425/6 |
| 2017/0008325 | A1 * | 1/2017 | Hiraoka | C09D 167/00 |
| 2017/0247564 | A1 * | 8/2017 | Kominami | C09D 175/16 |
| 2017/0354991 | A1 * | 12/2017 | Kim | B05D 7/14 |
| 2018/0066149 | A1 * | 3/2018 | Nishiyama | B41J 2/01 |

FOREIGN PATENT DOCUMENTS

| | | | | |
|---|---|---|---|---|
| JP | H11-106947 | A | 4/1999 | |
| JP | 2000-034438 | A | 2/2000 | |
| JP | 2000-254998 | A | 9/2000 | |
| JP | 2005-508770 | A | 4/2005 | |
| JP | 2008-179026 | A | 8/2008 | |
| JP | 2008-218312 | A | 9/2008 | |
| JP | 2009-274341 | A | 11/2009 | |
| JP | 2010-125358 | A | 6/2010 | |
| JP | 2011-200763 | A | 10/2011 | |
| JP | 2012-126080 | A | 7/2012 | |
| JP | 2013-502480 | A | 1/2013 | |
| JP | 2014-177002 | A | 9/2014 | |
| JP | 2014-213247 | A | 11/2014 | |
| KR | 2013-0056926 | A | 5/2013 | |
| KR | 10-1387638 | B1 | 4/2014 | |
| KR | 10-1403769 | B1 | 6/2014 | |
| KR | 10-1450802 | B1 | 10/2014 | |
| KR | 10-1459358 | B1 | 11/2014 | |
| WO | WO-2008051512 | A3 * | 6/2008 | G03F 7/40 |
| WO | 2011/136172 | A1 | 11/2011 | |
| WO | WO-2016104913 | A1 * | 6/2016 | B05D 7/14 |

OTHER PUBLICATIONS

Japanese Office Action dated Jun. 26, 2018 issued in Japanese Patent Application No. 2017-533546 (with English translation).

* cited by examiner

【FIG. 1】
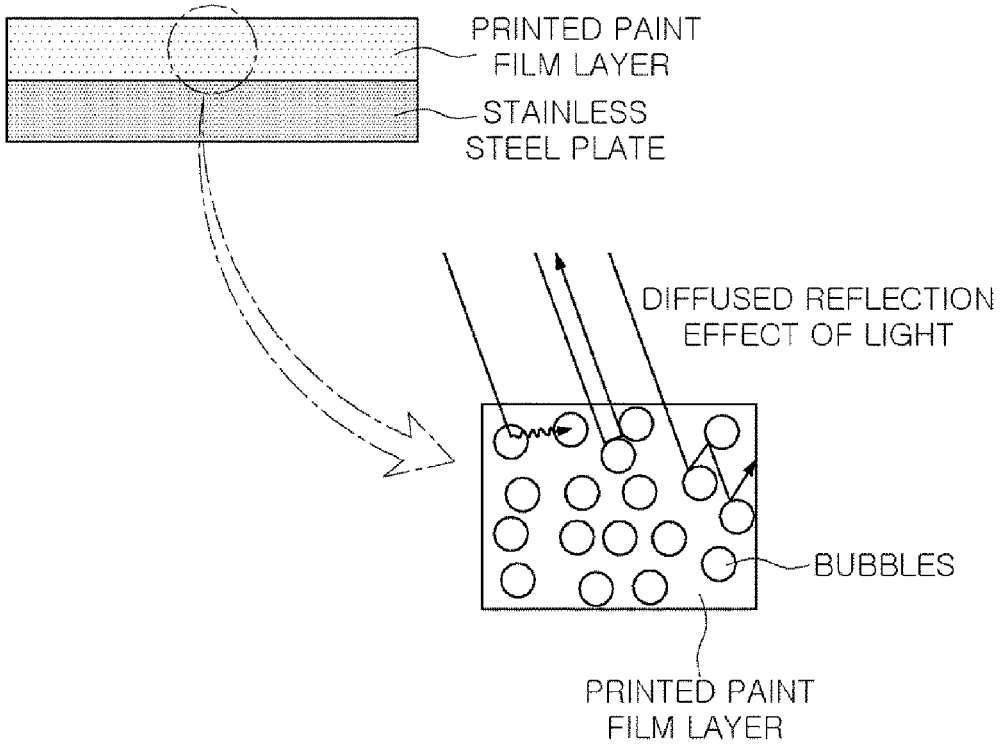
【FIG. 2】
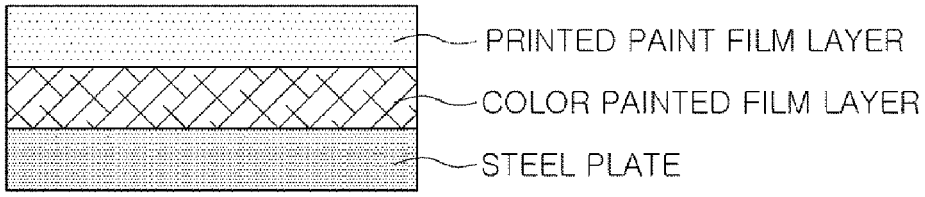

METHOD FOR MANUFACTURING TRANSPARENT PATTERN PRINT STEEL PLATE

RELATED APPLICATIONS

This application is the U.S. National Phase under 35 U.S.C. § 371 of International Patent Application No. PCT/KR2015/008645, filed on Aug. 19, 2015, which in turn claims the benefit of Korean Patent Application No. 10-2014-0187637, filed on Dec. 23, 2014, the disclosures of which Applications are incorporated by reference herein.

TECHNICAL FIELD

The present disclosure relates to a method of manufacturing a transparent pattern printed steel plate.

BACKGROUND ART

In the case of applying designs to steel plates by acid etching, pattern printing is performed on the steel plates using polymer resins, and then, portions of the steel plates without patterns printed thereon are dissolved in acid through acid etching to produce etching patterns. In addition, after the etching of steel plates, polymer pattern printed portions should be melted to expose the non-etched portions of the steel plates. Since products are produced through sequential operations of polymer pattern printing, drying, acid etching, washing, polymer pattern removal, and washing, the process may be complicated and operating costs may be high.

On the other hand, when a printed steel plate is manufactured by a method of applying a design to a steel plate using a solution, silica particles as a matting agent are added together with the solution to provide the feeling of etching with the solution. As a result, a feeling of etching may be realized by lowering the gloss of a solution. However, when an excessive amount of silica is added to a solution, the hardness of a paint film may be increased, processability may be poor, and resolution may be lowered. Further, in a printing process using inkjet printing, a phenomenon in which several micro-silica particles plug an ink jet nozzle may be problematic.

Color coated steel plates, for example, black coated steel plates, do not have pattern designs applied to the materials themselves. Thus, in order to achieve high quality in, and differentiation of, products, a technique of manufacturing a high quality color printed steel plate is required.

TECHNICAL PROBLEM

An aspect of the present disclosure is to provide a method of manufacturing a transparent pattern printed steel plate having a relatively high hardness painted film and excellent processability, using a solution containing no matting agent, while simplifying an existing etching pattern process to lower process operating costs.

TECHNICAL SOLUTION

According to an aspect of the present disclosure, a method of manufacturing a transparent pattern printed steel plate includes forming a printed paint film layer by jetting transparent ink onto at least one surface of a steel plate, and curing the printed paint film layer with ultraviolet light to form a cured printed paint film layer.

The method of manufacturing a transparent pattern printed steel plate may further include drying the printed paint film layer at room temperature after the forming of the printed paint film layer.

The drying may be performed for a period of time exceeding zero second to 2 seconds or less.

The method of manufacturing a transparent pattern printed steel plate may further include performing preprocessing on a surface of the steel plate with plasma, before the forming of the printed paint film layer.

The jetting may be performed using inkjet printing or laser printing.

The jetting may be performed at a rate of 1 kHz to 20 kHz.

The cured printed paint film layer may have a thickness of 1 μm to 20 μm, and may have a degree of glossiness of 3 to 50, based on 60 degrees.

The cured printed paint film layer may include bubbles having an average diameter of 0.5 μm to 3 μm.

The steel plate may be a stainless steel plate; an aluminum-plated steel plate; a galvanized steel plate; a zinc alloy plated steel plate; a plated steel plate including cobalt, molybdenum, tungsten, nickel, titanium, aluminum, manganese, iron magnesium, tin, copper, an impurity such as mixtures thereof, or a dissimilar metal, contained in a plating layer of the plated steel plate; an aluminum alloy plate including silicon, copper magnesium, iron, manganese, titanium, zinc or mixtures thereof, added thereto; a cold-rolled steel plate; or a hot-rolled steel plate.

According to an aspect of the present disclosure, a method of manufacturing a transparent pattern printed steel plate includes preparing a steel plate having a color painted film layer formed on at least one surface thereof, forming a printed paint film layer by jetting transparent ink onto the color painted film layer, and curing the printed paint film layer to form a cured printed paint film layer.

The method of manufacturing a transparent pattern printed steel plate may further include drying the printed paint film layer at room temperature, after the forming of the printed paint film layer.

The drying may be performed for a period of time of 5 seconds or more.

The method of manufacturing a transparent pattern printed steel plate may further include performing preprocessing on a surface of the color painted film layer with plasma, before the forming of the printed paint film layer.

The jetting may be performed using inkjet printing or laser printing.

The jetting may be performed at a rate of 1 kHz to 20 kHz.

The color painted film layer may have a dried paint film thickness of 1 μm to 30 μm, and may have a degree of glossiness of 5 to 90, based on 60 degrees.

The cured printed paint film layer may have a thickness of 0.5 μm to 30 μm, and may have a degree of glossiness of 60 to 110, based on 60 degrees.

The steel plate may be a stainless steel plate; an aluminum-plated steel plate; a galvanized steel plate; a zinc alloy plated steel plate; a plated steel plate including cobalt, molybdenum, tungsten, nickel, titanium, aluminum, manganese, iron magnesium, tin, copper, an impurity such as mixtures thereof, or a dissimilar metal, contained in a plating layer of the plated steel plate; an aluminum alloy plate including silicon, copper magnesium, iron, manganese, titanium, zinc, or mixtures thereof, added thereto; a cold-rolled steel plate; or a hot-rolled steel plate.

ADVANTAGEOUS EFFECTS

A method of manufacturing a transparent pattern printed steel plate according to an exemplary embodiment in the present disclosure may provide an effect of simplifying an existing etching pattern process to lower process operating costs, and a transparent pattern printed steel plate having relatively high hardness and excellent processability may be provided.

DESCRIPTION OF DRAWINGS

FIG. 1 illustrates a cross section of a stainless steel plate including a printed paint film layer.

FIG. 2 illustrates a cross section of a color coated steel plate including a printed paint film layer.

BEST MODE

Hereinafter, exemplary examples in the present disclosure will be described with reference to the accompanying drawings. However, exemplary embodiments in the present disclosure may be variously modified, and the scope of the present invention is not limited to exemplary embodiments described below.

In the case of a method of manufacturing a transparent pattern printed steel plate according to an exemplary embodiment in the present disclosure, an etching effect on a steel plate may be implemented using transparent ink, and a high linear pattern effect may be implemented on a color coated steel plate.

A method of manufacturing a transparent pattern printed steel plate, to provide an etching effect on a steel plate, may include a printed paint film layer formation operation of forming a printed paint film layer by jetting transparent ink onto at least one surface of a steel plate, and a curing operation of forming a cured printed paint film layer by curing the printed paint film layer using ultraviolet light.

On the other hand, a method of manufacturing a transparent pattern printed steel plate, implementing a high linear pattern effect on a color coated steel plate, may include an operation of preparing a steel plate having a color painted film layer formed on at least one surface thereof, a printed paint film layer formation operation of forming a printed paint film layer by jetting transparent ink onto the color painted film layer, and a curing operation of forming a cured printed paint film layer by curing the printed paint film layer.

In the related art, a steel plate is directly etched using an acid solution, or a solution containing a matting agent is applied to an upper portion of a steel plate to provide an etching effect. However, a direct etching method using an acid solution may have a problem in that a process thereof is complicated and process operating costs are relatively high. Further, the method using a solution containing a matting agent may have a problem in which hardness of a painted film is relatively low and processability of a steel plate is deteriorated, due to a side reaction between the matting agent and the steel plate.

However, in the method of manufacturing a transparent pattern printed steel plate according to an exemplary embodiment in the present disclosure, for example, when transparent ink is jetted onto at least one surface of a steel plate by a printing technique to generate micro-sized bubbles, a transparent pattern having an etching effect may be represented. When a diffused reflection of light is generated in the bubbles, gloss of the steel plate may be reduced, thereby significantly increasing an etching effect on a portion thereof on which transparent ink is jetted.

An average diameter of the bubbles formed on the steel plate may be 0.5 μm to 3 μm. If the average diameter of the bubbles is less than 0.5 μm, the size of the bubbles is relatively small to lower a diffused reflection effect of light. If the average diameter of the bubbles exceeds 3 μm, the diffused reflection effect of light may be excellent, but an air layer of the bubbles may increase excessively, thereby reducing physical properties of a painted film.

In general, the inkjet printing method may be applied to a material such as paper or cloth, capable of easily absorbing ink, such that bubbles generated by ink jetting may be absorbed by the material to disappear. However, according to an exemplary embodiment in the present disclosure, when ink is jetted onto a surface of a steel plate, microbubbles may remain without being absorbed by a material, and in order to maintain such a state, the ink may be cured within a rapid time within 2 seconds.

In order to significantly reduce extinction of bubbles generated on the steel plate by high-speed jetting of inkjet, the transparent ink may be rapidly cured within 2 seconds after jetting thereof onto an adherend. For example, in order to significantly reduce extinction of bubbles, the ink may be cured using ultraviolet light within 2 seconds of high-speed jetting of an inkjet.

A period of time, after transparent ink is jetted onto the steel plate and before ultraviolet curing is undertaken, may be more than 0 second and equal to or less than 2 seconds. If the period of time exceeds 2 seconds, the bubbles generated on the steel plate may disappear and the diffused reflection effect of light may not appear, thereby lowering an etching effect due to a printed paint film layer.

On the other hand, in the case in which a printed paint film layer is directly formed on the steel plate, separation of a painted film may occur. Thus, preprocessing may be performed through a plasma pretreatment. By performing a plasma treatment before forming the printed paint film layer, surface characteristics of the steel plate may be improved to improve adhesion between the printed paint film layer and a steel plate surface. In addition, foreign matter on the surface of the steel plate may be removed by the plasma treatment, thereby improving the adhesion between the printed paint film layer and the steel plate surface.

The transparent ink may be a mixture of one or more resin components selected from polymer-based, epoxy-based, urethane-based and ester-based acrylate oligomers, such as polyester, modified polyester, and high polymer polyester, and the like, but is not limited thereto.

The jetting of the transparent ink is not particularly limited as long as it is performed using a general ink jetting apparatus, and may be performed, for example, by ink jet printing or laser printing.

For example, when transparent ink is jetted onto the steel plate, a jetting speed thereof may be within a range of 1 kHz to 20 kHz. If the jetting speed of the transparent ink is less than 1 kHz, bubbles may not be sufficiently generated on a surface of the steel plate, such that an etching effect on the printed paint film layer may not be exhibited. If the jetting speed exceeds 20 kHz, a relatively excessive amount of the transparent ink may be jetted, such that a required design may not be expressed.

On the other hand, the cured printed paint film layer may have a thickness of 1 μm to 20 μm. If the thickness of the cured printed paint film layer is less than 1 μm, a quenching effect may be reduced and the effect on an etched steel plate may not be obtained. If the thickness thereof exceeds 20 μm, the quenching effect may be excellent due to bubbles of a printed paint film, but separation of the printed paint film may occur.

The cured printed paint film layer may have a surface gloss of 3 to 50, based on 60 degrees. If the surface gloss is less than 3, the etching effect may be excellent, but since the number of bubbles may be increased, physical properties of the printed paint film may be relatively lowered. If the surface gloss exceeds 50, the etching effect on the printed paint film layer may not be exhibited.

The steel plate may be a stainless steel plate; an aluminum-plated steel plate; a galvanized steel plate; a zinc alloy plated steel plate; a plated steel plate including cobalt, molybdenum, tungsten, nickel, titanium, aluminum, manganese, iron, magnesium, tin, copper, an impurity such as mixtures thereof, or a dissimilar metal, contained in a plating layer thereof; an aluminum alloy plate including silicon, copper magnesium, iron, manganese, titanium, zinc or mixtures thereof, added thereto; a cold-rolled steel plate; or a hot-rolled steel plate.

FIG. 1 illustrates a cross section of a stainless steel plate including a printed paint film layer. As illustrated in FIG. 1, as diffused reflection of light occurs in bubbles included in the printed paint film layer, the printed paint film layer may have an etching effect.

For example, in applying a method of manufacturing a transparent pattern printed steel plate according to an exemplary embodiment to a color coated steel plate, a color coated steel plate having relatively high linearity and high gloss effects may be produced. In detail, the method of manufacturing a transparent pattern printed steel plate may include an operation of preparing a steel plate having a color painted film layer formed on at least one surface thereof, a printed paint film layer formation operation of forming a printed paint film layer by jetting transparent ink onto the color painted film layer, and a curing operation of curing a cured printed paint film layer by curing the printed paint film layer. Thus, a color coated steel plate having relatively high linear and high gloss effects may be manufactured.

In the case of a color coated steel plate produced according to an exemplary embodiment in the present disclosure, a high-linear and high-gloss pattern may be introduced onto a coated steel plate formed of a monochromatic color such as black or the like, a general color, using transparent ink, thereby providing a high-grade and differentiated product. Further, a transparent pattern printed steel plate free from damage and deformation of a printing pattern during a molding process may be provided.

A chromium-free layer may be formed by applying a chromium-free pretreatment coating solution to at least one surface of a steel plate, and then, a color painted film layer may be formed on the chromium-free layer. Alternatively, the color painted film layer may be directly formed on at least one surface of the steel plate without forming the chromium-free layer.

A resin included in the color painted film layer may be a polyester-based polymer resin, and a molecular weight of the polymer resin may be 10,000 to 25,000. The color painted film layer including the resin may be black in color.

On the other hand, the color painted film layer may have a dried painted film thickness of 1 μm to 30 μm. If the dried painted film thickness is less than 1 μm, a painted film thickness is too low to secure physical properties. If the painted film thickness exceeds 30 μm, physical properties may be stable, but economic problems may occur. In addition, the color painted film layer may have a surface gloss of 5 to 90, based on 60 degrees.

After the color painted film layer is formed, a printed paint film layer may be formed by jetting transparent ink onto the color painted film layer. The transparent ink may be one of transparent natural drying, thermosetting, and ultraviolet light curable inks, and thus, the printed paint film layer may be cured by natural drying, heat or ultraviolet light, depending on the type of transparent ink. In addition, the transparent ink may be a mixture of at least one or more resin components selected from polymer-based, epoxy-based, urethane-based and ester-based acrylate oligomers, such as polyester, modified polyester, high polymer polyester, and the like.

The jetting of the transparent ink is not particularly limited as long as it is performed using a general ink jetting apparatus, and may be performed, for example, by inkjet printing or laser printing.

In addition, when the transparent ink is jetted onto the color painted film layer, a jetting speed thereof may be within a range of 1 kHz to 20 kHz. If the jetting speed is less than 1 kHz, a jetting speed of the jetted ink may be lowered, and thus, a resolution of a printed paint film may be lowered. If the jetting speed exceeds 20 kHz, an excessive amount of bubbles may be generated on a color coated steel plate to cause diffused reflection of light due to the bubbles, such that high gloss and high linearity effects may not be provided.

Thus, the transparent ink may be jetted onto a color coated steel plate, and then, may be dried for 5 seconds or more at room temperature, such that bubbles may not remain in the printed paint film layer to then be cured after a leveling time for bubble removal.

For example, after the printed paint film layer is formed, an operation of drying the printed paint film layer at room temperature may be further performed. In this case, the drying may be performed for a period of time of 5 seconds or more. If the bubble removal time is less than 5 seconds, since diffused reflection of light may occur due to the bubbles, high gloss and high linear transparent pattern printing effects may not be implemented. On the other hand, when the bubble removal time is equal to or more than 5 seconds, the bubbles may be removed, and the leveling of the printed paint film may be self-completed, thereby providing high linearity and high gloss effects.

After the leveling time of a numerical range has elapsed, the printed paint film layer may be cured to form a cured printed paint film layer. The cured printed paint film layer may have a thickness of 0.5 μm to 30 μm. If the thickness of the cured printed paint film layer is less than 0.5 μm, high gloss and high linearity effects may not be exhibited. If the thickness thereof exceeds 30 μm, a painted film tends to be broken and adhesion force thereof may be lowered.

On the other hand, the cured printed paint film layer may have a surface gloss of 60 to 110, based on 60 degrees. If the surface gloss is less than 60, the effect of high gloss and high linearity may not be exhibited. If the surface gloss exceeds 110, there is no problem in implementing high gloss and high linearity, but there may be negative properties in that exposure of surface defects, such as a blemish or dust, is facilitated.

Before the printed paint film layer formation operation, a preprocessing operation of treating a surface of the color painted film layer with plasma may be further performed. By preprocessing the color painted film layer, the surface of the color painted film layer may be cleaned, and bonding force between the color painted film layer and the printed paint film layer may be increased.

The steel plate may be a stainless steel plate; an aluminum-plated steel plate; a galvanized steel plate; a zinc alloy plated steel plate; a plated steel plate including cobalt, molybdenum, tungsten, nickel, titanium, aluminum, manganese, iron magnesium, tin, copper, an impurity such as mixtures thereof, or a dissimilar metal, contained in a plating layer thereof; an aluminum alloy plate including silicon, copper magnesium, iron, manganese, titanium, zinc or mixtures thereof, added thereto; a cold-rolled steel plate; or a hot-rolled steel plate.

FIG. 2 illustrates a cross section of a color coated steel plate including a printed paint film layer. In a manner different from that of the printed paint film layer formed on the stainless steel plate of FIG. 1, since the printed paint film layer illustrated in FIG. 2 does not include bubbles, a diffused reflection effect of light may not occur, and thus, high linearity or high gloss effects may be obtained.

MODE FOR INVENTION

Hereinafter, an exemplary embodiment in the present disclosure will be described in further detail. The following embodiments are provided for illustrative examples only and should not be construed as limiting the scope of the invention.

Embodiment

1. Printed Paint Film Layer Formed on Stainless Steel Plate

A stainless steel plate having a thickness of 0.4 mm to 0.5 mm was irradiated with plasma having a strength of 800 W in air for 10 seconds, and then, a transparent ultraviolet curable ink containing no pigment was pattern printed with inkjet printing.

In this case, the ink was jetted at a speed of 12 kHz, and a continuous process was performed to be within 2 seconds from ink jetting to initiation of ultraviolet curing. Table 1 provides the results of degrees of glossiness and printing adhesion according to changes in painted film thicknesses.

TABLE 1

| Classification | Painted Film Thickness | Degree of Glossiness | Printing Adhesion |
|---|---|---|---|
| Embodiment 1 | 1 | 40 to 45 | Good |
| Embodiment 2 | 5 | 3 to 25 | Good |
| Embodiment 3 | 10 | 10 to 35 | Good |
| Embodiment 4 | 15 | 15 to 40 | Good |
| Embodiment 5 | 20 | 25 to 50 | Good |
| Comparative Example 1 | 30 | 55 to 60 | Defective |

As shown in Table 1, it was confirmed that, in Embodiments 1 to 5, in which a painted film thickness is 1 μm to 20 μm, adhesion between a printed paint film layer and a stainless steel plate was good, while Comparative Example 1 had poor adhesion.

2. Printed Paint Film Layer Formed on Color Coated Steel Plate

A galvanized steel plate having a thickness of 0.4 mm to 0.5 mm was coated with a polyester-based polymer resin having black in color, to have a thickness of 10 μm, to be followed by drying and curing. Then, a transparent high-linear ultraviolet curing ink was pattern-printed on the dried painted film of a black polymer resin layer by inkjet printing.

After leveling for removal of bubbles was performed to prevent the bubbles from remaining, the printed paint film layer was cured. Table 2 provides the results of painted film glossiness degrees according to leveling time.

TABLE 2

| Classification | Ink leveling time (Second) after Jetting | Degree of Glossiness |
|---|---|---|
| Comparative Example 2 | 1 | 30 |
| Comparative Example 3 | 3 | 55 |
| Embodiment 6 | 5 | 85 |
| Embodiment 7 | 7 | 93 |
| Embodiment 8 | 9 | 95 |

As shown in Table 2, it was confirmed that Embodiments 6 to 8 having a leveling time of 5 seconds or more exhibited high gloss of 85 or more, and thus, exhibited high gloss and high linearity, as compared to Comparative Examples 2 and 3.

INDUSTRIAL APPLICABILITY

According to an exemplary embodiment in the present disclosure, by simplifying an etching pattern process of a zone to lower process operating costs, a transparent pattern printed steel plate having relatively high hardness of a painted film and excellent processability may be provided, thereby providing remarkable industrial applicability.

The invention claimed is:

1. A method of manufacturing a transparent pattern printed steel plate, comprising:

forming a printed paint film layer by jetting transparent ink onto at least one surface of a steel plate at a rate of 1 kHz to 20 kHz;

curing the printed paint film layer with ultraviolet light to form a cured printed paint film layer; and after the forming of the printed paint film layer, drying the printed paint film layer at room temperature for a period of time exceeding 0 seconds to 2 seconds or less.

2. The method of claim 1, further comprising performing preprocessing on a surface of the steel plate with plasma, before the forming of the printed paint film layer.

3. The method of claim 1, wherein the jetting is performed using inkjet printing or laser printing.

4. The method of claim 1, wherein the cured printed paint film layer has a thickness of 1 μm to 20 μm, and has a degree of glossiness of 3 to 50, based on 60 degrees.

5. The method of claim 1, wherein the cured printed paint film layer comprises bubbles having an average diameter of 0.5 μm to 3 μm.

6. The method of claim 1, wherein the steel plate is a stainless steel plate; an aluminum-plated steel plate; a galvanized steel plate; a zinc alloy plated steel plate; a plated steel plate including cobalt, molybdenum, tungsten, nickel, titanium, aluminum, manganese, iron, magnesium, tin, copper, mixtures thereof, or a dissimilar metal, contained in a plating layer of the plated steel plate; an aluminum alloy plate including silicon, copper magnesium, iron, manganese, titanium, zinc or mixtures thereof, added thereto; a cold-rolled steel plate; or a hot-rolled steel plate.

7. A method of manufacturing a transparent pattern printed steel plate, comprising:

preparing a steel plate having a color painted film layer formed on at least one surface thereof;

forming a printed paint film layer by jetting transparent ink onto the color painted film layer at a rate of 1 kHz to 20 kHz;

curing the printed paint film layer to form a cured printed paint film layer; and after the forming of the printed paint film layer, drying the printed paint film layer at room temperature for a period of time of 5 seconds or more.

8. The method of claim 7, further comprising performing preprocessing on a surface of the color painted film layer with plasma, before the forming of the printed paint film layer.

9. The method of claim 7, wherein the jetting is performed using inkjet printing or laser printing.

10. The method of claim 7, wherein the color painted film layer has a dried paint film thickness of 1 μm to 30 μm, and has a degree of glossiness of 5 to 90, based on 60 degrees.

11. The method of claim 7, wherein the cured printed paint film layer has a thickness of 0.5 μm to 30 μm, and has a degree of glossiness of 60 to 110, based on 60 degrees.

12. The method of claim 7, wherein the steel plate is a stainless steel plate; an aluminum-plated steel plate; a galvanized steel plate; a zinc alloy plated steel plate; a plated steel plate including cobalt, molybdenum, tungsten, nickel, titanium, aluminum, manganese, iron magnesium, tin, copper, mixtures thereof, or a dissimilar metal, contained in a plating layer of the plated steel plate; an aluminum alloy plate including silicon, copper magnesium, iron, manganese, titanium, zinc, or mixtures thereof, added thereto; a cold-rolled steel plate; or a hot-rolled steel plate.

13. The method of claim 1, wherein the transparent ink is cured within 2 seconds after jetting the transparent ink onto at least one surface of the steel plate.

14. The method of claim 1, wherein the transparent ink is a mixture of one or more resin components selected from the group consisting of polymer-based, epoxy-based, urethane-based and ester-based acrylate oligomers.

15. The method of claim 1, wherein the transparent ink is a mixture of one or more resin components selected from the group consisting of polyester, modified polyester and high polymer polyester.

16. The method of claim 7, wherein the transparent ink is cured within 2 seconds after jetting the transparent ink onto at least one surface of the steel plate.

17. The method of claim 7, wherein the transparent ink is a mixture of one or more resin components selected from the group consisting of polymer-based, epoxy-based, urethane-based and ester-based acrylate oligomers.

18. The method of claim 1, wherein the transparent ink is a mixture of one or more resin components selected from the group consisting of polyester, modified polyester and high polymer polyester.

* * * * *